US006362799B1

(12) United States Patent
Ueoka et al.

(10) Patent No.: US 6,362,799 B1
(45) Date of Patent: Mar. 26, 2002

(54) PLASMA DISPLAY

(75) Inventors: Mitsuo Ueoka; Hidekazu Takada, both of Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/293,980

(22) Filed: Apr. 19, 1999

(30) Foreign Application Priority Data

Apr. 22, 1998 (JP) ..... 10-111654

(51) Int. Cl.[7] ..... G09G 3/28

(52) U.S. Cl. ..... 345/60; 345/62; 345/63; 345/65; 345/66; 345/67; 345/68; 345/77; 345/80; 313/582; 313/583; 313/585; 313/631

(58) Field of Search ..... 345/60, 67, 69, 345/59, 61, 63, 68, 62, 65, 77, 80; 313/582, 584, 583, 631, 585

(56) References Cited

U.S. PATENT DOCUMENTS

| | | | | |
|---|---|---|---|---|
| 5,684,499 A | * | 11/1997 | Shimizu et al. | 345/60 |
| 5,903,245 A | * | 3/2000 | Shimizu | 345/60 |
| 6,034,474 A | * | 3/2000 | Ueoka et al. | 313/584 |
| 6,068,923 A | * | 5/2000 | Noborio et al. | 315/169.4 |
| 6,097,357 A | * | 8/2000 | Shinoda et al. | 345/63 |

FOREIGN PATENT DOCUMENTS

| | | |
|---|---|---|
| JP | 3-283233 | 12/1991 |
| JP | 5-101782 | 4/1993 |
| JP | 6-318052 | 11/1994 |
| JP | 7-182978 | 7/1995 |
| JP | 7-319423 | 12/1995 |

* cited by examiner

*Primary Examiner*—Richard Hjerpe
*Assistant Examiner*—Ali Zamani
(74) *Attorney, Agent, or Firm*—Young & Thompson

(57) ABSTRACT

A plasma display panel has a pair of insulating substrates (a front substrate and a rear substrate) which face each other. A plurality of surface discharge electrodes, each including a transparent scanning electrode and a transparent maintaining electrode arranged with a surface discharge gap in between, are formed in a matrix form on the front substrate. A plurality of scanning trace electrodes, which are made of metal material, are formed extending horizontally on the scanning electrodes. A plurality of first partition walls are formed vertically extending in stripes between the surface discharge electrodes. A plurality of maintaining trace electrodes, connected to the maintaining electrodes, are formed vertically extending on the first partition walls. The front substrate having the electrodes thus formed thereon is covered with a transparent dielectric layer and a magnesia oxide layer in sequence. Meanwhile, a white dielectric layer, which reflects visible light with high efficiency, is formed on the rear substrate. A plurality of second partition walls are formed vertically extending in stripes on the white dielectric layer. A plurality of phosphor layers are formed between the second partition walls by forming separate stripe coatings of phosphor materials for red, green and blue.

16 Claims, 8 Drawing Sheets

PLASMA DISPLAY

This application is based on Japanese Patent Application No. 10-111654 filed Apr. 22, 1998, which is incorporated herein by reference in its entirety.

BACKGROUND OF THE INVENTION

1. Field of the Invention

The present invention relates to a plasma display, and more particularly to the structure and drive of an AC memory type plasma display.

2. Description of the Related Art

A DC plasma display and an AC (AC memory type) plasma display are known conventionally. In particular, an AC memory type plasma display is widely used as a color display.

FIG. 9 illustrates the structure of a conventional AC memory type plasma display panel in cross section. As illustrated, this type of plasma display panel has a front substrate 41 and a rear substrate 45 which face each other and which are made of insulating material such as glass.

A plurality of transparent scanning electrodes 42*a* and maintaining electrodes 42*b*, formed from an ITO (Indium Tin Oxide) or Nesa film, are provided on the front substrate 41. Each of the scanning electrodes 42*a* and its corresponding one of the maintaining electrodes 42*b* form a surface discharge electrode 42. In order to reduce the resistances of the scanning and maintaining electrodes 42*a* and 42*b*, trace electrodes 43 are formed one on each of them. Normally, Cr/Cu/Cr (chrome/copper/chrome) stacked thin film electrodes or Ag (silver) thick film electrodes are employed as the trace electrodes 43.

A dielectric layer 44 is formed on the scanning electrodes 42*a*, the maintaining electrodes 42*b* and the trace electrodes 43. In general, lead glass having a low melting point is used to form the dielectric layer 44. An MgO film (not shown), having a thickness of approximately 0.5 $\mu$m to 1 $\mu$m, is formed on the dielectric layer 44 by vacuum vapor deposition, in order to prevent the dielectric layer 44 from being damaged by minus and plus ions and electrons, which are generated due to a gas discharge, and in order to lower a discharge voltage.

A plurality of data electrodes 46, which face the scanning and maintaining electrodes 42*a* and 42*b* and which are substantially perpendicular to the scanning and maintaining electrodes 42*a* and 42*b*, are formed on the rear substrate 45. Ag thick film electrodes are employed as the data electrodes 46. A white dielectric layer 47 is formed on the data electrodes 46. The white dielectric layer 47 is formed by printing and sintering glass paste prepared by mixing powder of white oxide (alumina, titanium oxide or the like), powder of lead glass having a low melting point, etc. The white dielectric layer 47 has the function of reflecting light emitted from phosphor layers 48 and directing the light toward the front substrate 41.

The phosphor layers 48 are formed on the white dielectric layer 47. The phosphor layers 48 are separate coatings of three phosphor materials applied onto the white dielectric layer 47 by thick film printing techniques and which respectively emit red, green and blue visible light when they are excited by ultraviolet rays generated due to the gas discharge.

The front and rear substrates 41 and 45 are arranged facing each other with a gap of 100 $\mu$m to 200 $\mu$m in between and with partition walls (not shown) in a lattice or stripe pattern being provided therebetween. The partition walls are made of a mixture of lead glass and one of magnesia oxide, titanium oxide, etc. A discharge gas, which essentially consists of a mixture of rare gases such as He (helium), Ne (neon) and Xe (xenon) gases, is filled in the gap between the front and rear substrates 41 and 45, and the peripheral portions of those substrates are sealed by a seal member. Employing the above-described structure, discharge cells 49 are formed between the front and rear substrates 41 and 45.

A drive method for the plasma display panel illustrated in FIG. 9 will now be described. This type of plasma display panel is driven by a subfield drive method such as that shown in FIG. 10. According to this drive method, a field which constitutes a single image is repeated about 50 to 70 times per second. Due to the afterimage effect, each field image displayed successively stays in the viewer's eyes, which ensures a flicker-free natural image displayed on the plasma display panel.

A field is divided into a plurality of subfields. The subfields differ from each other in the number of maintaining pulses (the number of discharge times) generated during a maintaining period which will be described later. A multi-gradation image is displayed by combining the subfields into one field. For example, in the case of displaying a 64-gradation image, a field (F) is divided into 6 subfields (SF1 to SF6) as illustrated in FIG. 10. In each of the subfields SF1 to SF6, a preliminary lighting period, a preliminary erasing period and a writing period come in sequence, and a maintaining period follows. During the maintaining period, a surface discharge is caused between the scanning and maintaining electrodes 42*a* and 42*b*. The number of times the surface discharge is caused in the subfield SF1 is 32n (n: a positive integer). This number is progressively reduced by ½ at a time in the sequence of the subfield SF2 to the subfield SF6, whereby each subfield is weighted.

The drive operation of the above-described plasma display panel during one subfield period, more specifically, the discharge operation of a discharge cell 19, will now be explained with reference to FIGS. 11A to 11D illustrating the waveforms of drive voltage pulses. In FIGS. 11A to 11D, reference character D represents a train of data pulses to be applied to the data electrodes 46. Reference symbol SO denotes a train of drive voltage pulses to be applied to the $0^{th}$ scanning electrode 42*a*. Reference symbol Sm represents a train of drive voltage pulses to be applied to the $m^{th}$ scanning electrode 42*a*. Reference character C denotes a train of drive voltage pulses to be applied to the maintaining electrodes 42*b*.

In the preliminary lighting period which comes first, a preliminary discharge pulse $P_P$ is applied to all scanning electrodes 42*a* in order to cause a surface discharge between the electrodes 42*a* and 42*b*. In the next preliminary erasing period, pulses $P_{E1}$, $P_{E2}$ and $P_{E3}$ are sequentially applied to the scanning and maintaining electrodes 42*a* and 42*b* in order to erase wall charges which have been generated between the electrodes 42*a* and 42*b* during the preliminary lighting period.

In the writing period, a writing pulse $P_W$ is applied to the selected scanning electrodes 42*a* of the plasma display panel so as to sequentially scan them. In synchronization with this, data pulses $P_D$ according to the display data are applied to the data electrodes 46. By so doing, a discharge between the selected scanning electrodes 42*a* and the data electrodes 46 supplied with the predetermined data pulses $P_D$ is caused at the opposite surfaces of those electrodes 42*a* and 46 such that wall charges are generated in the pixels supplied with the predetermined data pulses $P_D$. In the next maintaining period, maintaining pulses $P_{SUS}$ are applied to the scanning electrodes 42*a* and the maintaining electrodes 42*b* so as to be superimposed on the wall charges. By thus superimposing the maintaining pulses $P_{SUS}$, the discharge caused during the writing period is maintained as a surface discharge between the scanning and maintaining electrodes 42*a* and 42*b*.

As explained above, according to the conventional AC memory type plasma display panel, the discharge caused between the opposite surfaces of the scanning and data electrodes 42*a* and 46 is utilized to write the display data in each pixel. The scanning electrodes 42*a* are covered with a magnesia oxide film which has excellent properties as discharge proof material, while the data electrodes 46 are covered with the phosphor layers 48.

Owing to the above structure, the potential of the scanning electrodes 42*a* is lower than that of the data electrodes 46 at the time of writing display data, as shown also in FIGS, 11B to 11D. This prevents positively charged particles, having a relatively large mass and whose sputtering efficiency is high, from impinging against the phosphor layers 48, and therefore prevents the phosphor layers 48 from being deteriorated or suffering damage due to the impingement. Furthermore, the luminance degradation and any variation in the discharge voltage, which would occur if the phosphor layers 48 were sputtered and the adhesion of material scattered therefrom were to occur, can also be prevented.

However, according to the conventional AC memory type plasma display panel described above, a weak discharge can occur between the scanning and data electrodes 42*a* and 46 at the timing the data electrodes 46 become lower in potential than the scanning electrodes 42*a*. The weak discharge, if occurs, may cause the impingement of the positively charged particles against the phosphor layers 48. Even if the potential at the scanning electrodes 42*a* is set lower than the potential at the data electrodes 46 prior to the writing of the display data, the impingement of electrons against the phosphor layers 48 can occur so as to impart any damage on the phosphor layers 48.

Because of the above, when still images such as characters are constantly displayed in fixed positions on the plasma display panel, those pixels of the phosphor layers 48 which are constantly in an ON state or which have a higher luminance become deteriorated faster than the other pixels. The deterioration of such pixels of the phosphor layers 48 results in the conventional AC memory type plasma display panel having a drawback of the occurrence of what is called a burning phenomenon, in other words, non-uniformity of luminance of the pixels.

Moreover, the speed of deterioration of the phosphor layers due to the impingement of the electrons or other charged particles differs depending on a difference in phosphor material between the phosphor layers for red, blue and green. This results in the conventional AC memory type plasma display panel having a drawback in that the range of phosphor material selection, when forming separate coatings of multi-color phosphor materials as the phosphor layers 48, is narrow.

Furthermore, since the opaque trace electrodes 43 are formed on the scanning electrodes 42*a* and the maintaining electrodes 42*b*, the aperture ratio of the pixels is small. Because of this, the conventional AC memory type plasma display panel has a further drawback in that the efficiency of use of the light emitted from the phosphor layers 48 is accordingly low.

Published Unexamined Japanese Patent Application (Kokai) No. 3-283233 discloses a DC plasma display panel of another type which has a feature in the structure of its electrodes. However, the electrodes of this plasma display panel is complicated in structure, and therefore cannot be applied to a color plasma display panel which requires the formation of the phosphor layers.

Published Unexamined Japanese Patent Application (Kokai) No. 7-182978 also discloses a DC plasma display panel in which the front substrate is provided with cathodes, while the rear substrate is provided with anodes perpendicular to the cathodes. In order to display images, a discharge is caused at the intersections of the cathodes and anodes. In this plasma display panel, however, the structure of a discharge space is complicated, and the phosphor layers need to be formed on a discharge path in order to realize color display. In this case, the impingement of the positively charged particles and the electrons, which would cause the deterioration of the phosphor layers, is unavoidable.

Published Unexamined Japanese Patent Application (Kokai) No. 5-101782 discloses a plasma display panel in which the surface discharge electrodes are provided on the partition walls of the rear substrate, while the phosphor layers are formed on both the front and rear substrates. In this plasma display panel, however, the data electrodes are arranged under the phosphor layers of the front substrate, and a discharge prior to driving causes the deterioration of the phosphor layers, as described previously.

In addition, Published Unexamined Japanese Patent Applications (Kokai) Nos. 6-318052 and 7-319423 disclose techniques for plasma displays. Those plasma displays have the structure wherein the electrodes provided on two substrates face each other, under which condition electrons and charged particles impinge on the phosphor layer when a discharge is caused between the electrodes.

SUMMARY OF THE INVENTION

It is accordingly an object of the present invention to provide a plasma display, which can suppress the deterioration of the phosphor layers due to the impingement of the charged particles and the electrons, and a drive method for the plasma display.

It is another object of the present invention to provide a plasma display, which can perform a writing discharge without any influence of a difference in phosphor material between the phosphor layers, and a drive method for the plasma display.

It is a further object of the present invention is to provide a plasma display, whose pixels have a large aperture ratio and which can utilize the light emitted from the phosphor layers with high efficiency, and a drive method for the plasma display.

It is a still further object of the present invention is to provide a plasma display, which can reliably perform a discharge at a low voltage, and a drive method for the plasma display.

It is a still further object of the present invention to provide a plasma display from which an internal impure gas can be efficiently removed.

It is another object of the present invention to provide a plasma display, whose drivers are fewer than conventionally used, and a drive method for the plasma display.

According to the first aspect of the present invention having the above-described objects, there is provided a plasma display comprising:

a first substrate on which are sequentially formed a matrix of surface discharge electrodes arranged in rows and columns, a plurality of scanning trace electrodes, a plurality of maintaining trace electrodes and a first dielectric layer, each of the surface discharge electrodes comprising a scanning electrode and a maintaining electrode arranged with a predetermined gap in between and which cause a discharge upon a voltage application, each of the scanning trace electrodes connecting the scanning electrodes included in one of the rows of the matrix, the maintaining trace electrodes intersecting the scanning trace electrodes with insulators being provided between the scanning trace and maintaining trace electrodes, each of the maintaining trace electrodes connecting the maintaining electrodes included in one of the columns of the matrix, and the first dielectric layer having an insulation property and covering the scanning electrodes and maintaining electrodes of the surface discharge electrodes, the scanning trace electrodes and the maintaining trace electrodes;

a second substrate facing the first substrate and on which are sequentially formed a second dielectric layer having an insulation property and a plurality of phosphor layers, the phosphor layers emitting predetermined visible light when they are excited by light generated due to the discharge caused between the scanning and maintaining electrodes; and a discharge gas filled between the first and second substrates and which generates light due to the discharge caused between the scanning and maintaining electrodes.

In the above-described plasma display apparatus, the electrodes are not formed under the phosphor layers provided above the second substrate. Hence, a discharge through the phosphor layers does not occur, and therefore the phosphor layers are not deteriorated or damaged due to the impingement of the electrons and other charged particles, ensuring long life of the phosphor layers.

In the above-described plasma display, the first substrate may further be provided with first partition walls extending in a direction which is substantially perpendicular to the scanning trace electrodes, and having an insulation property to insulate the columns of surface discharge electrodes from each other and to define a discharge space between the first and second substrates. In this case, the maintaining trace electrodes can be arranged on the first insulating partition walls.

It is preferred that the scanning electrodes and the maintaining electrodes be narrower than a space defined between the first partition walls.

In the above-described plasma display, the second substrate may be further provided with second partition walls to define a discharge space between the first and second substrates. In this case, the phosphor layers can be arranged between the second partition walls.

In the above-described plasma display, the first substrate may be further provided with first partition walls extending in a direction which is substantially perpendicular to the scanning trace electrodes, and having an insulation property to insulate the columns of surface discharge electrodes from each other and to define a discharge space between the first and second substrates. Further, the second substrate may be further provided with second partition walls to define a discharge space between the first and second substrates. In this case, the maintaining trace electrodes can be arranged on the first partition walls, and while the phosphor layers can be arranged between the second partition walls.

Moreover, in this case, the second partition walls may be formed on the second substrate so as to intersect the first partition walls at right angles, and the first and second substrates may be arranged facing each other in a state in which the first and second partition walls are in contact with each other, with the discharge space being defined between the first and second substrates.

By so doing, in the above-described plasma display, an evacuation path to remove an impure gas from the plasma display is formed extending in vertical and horizontal two directions, and the evacuation conductance is improved accordingly. Therefore, the impure gas within the plasma display can be assuredly removed.

In the above-described plasma display, the first substrate may have a discharge proof thin film formed on the first dielectric layer and which is high in a count of discharged secondary electrons.

It is preferred that this thin film be made of magnesia oxide.

Such a thin film made of magnesia oxide or the like, formed on the first substrate, ensures a discharge between the scanning and maintaining electrodes, and permits a low voltage to be used to cause the discharge.

In the above-described plasma display, the scanning electrodes and the maintaining electrodes may be made of transparent electrode material, the scanning trace electrodes and the maintaining trace electrodes may be made of opaque metal material, and the first dielectric layer may be made of transparent insulating material.

In general, opaque metal electrodes having a sheet resistance lower than that of transparent electrodes are adopted as the scanning trace electrodes and the maintaining trace electrodes. In the above-described plasma display, however, since such opaque maintaining trace electrodes need not be formed on the maintaining electrodes, the aperture ratio of the pixels is improved, and the efficiency of use of the visible light emitted from the phosphor layers is improved accordingly.

In the above-described plasma display, it is preferred that the second dielectric layer has a property of reflecting predetermined visible light which the phosphor layers emit.

By virtue of using a material, having a property of reflecting the visible light emitted from the phosphor layers, as the second dielectric layer, the efficiency of use of the visible light emitted from the phosphor layers is further improved.

In the above-described plasma display, each of the phosphor layers may comprise one of three phosphor materials which are arranged in a predetermined order and which respectively emit red, green and blue light when they are excited by the light generated due to the discharge.

Generally speaking, the speed of deterioration due to the impingement of electrons or other charged particles differs depending on a difference in phosphor material between the phosphor layers. In the above-described plasma display, however, since the electrons or other charged particles do not impinge against the phosphor layers, a difference in the speed of deterioration due to the impingement does not occur. Therefore, the phosphor materials for red, green and blue, which are to be separately coated to provide the phosphor layers for use in a color display, can be chosen from a wide range of selection.

In the above-described plasma display, the electrodes are not formed under the phosphor layers. Therefore, a discharge between the electrodes is not influenced by a difference in phosphor material between the phosphor layers.

In this case, it is preferred that the second dielectric layer have a property of reflecting any visible light emitted from the phosphor layers.

In the above-described plasma display, the discharge gas may essentially consist of a rare gas mixture containing helium, neon and xenon, for example, and may emit ultraviolet rays for exciting the phosphor layers, due to the discharge caused between the scanning and maintaining electrodes.

According to the second aspect of the present invention, there is provided a plasma display comprising:

a plasma display panel which includes a first substrate on which are sequentially formed a matrix of surface discharge electrodes arranged in rows and columns, a plurality of scanning trace electrodes, a plurality of maintaining trace electrodes and a first dielectric layer, each of the surface discharge electrodes comprising a scanning electrode and a maintaining electrode arranged with a predetermined gap in between and which cause a discharge upon a voltage application, each of the scanning trace electrodes connecting the scanning electrodes included in one of the rows of the matrix, the maintaining trace electrodes extending in a direction which is substantially perpendicular to the scanning trace electrodes and intersecting the scanning trace electrodes with insulators being provided between the scanning trace and maintaining trace electrodes, each of the maintaining trace electrodes connecting the maintaining electrodes included in one of the columns of the matrix, the first dielectric layer having an insulation property and covering the scanning electrodes and maintaining electrodes of the surface discharge electrodes, the scanning trace electrodes and the maintaining trace electrodes, a second substrate facing the first substrate and on which are sequentially formed a second dielectric layer having an insulation property and a plurality of phosphor layers which emit predetermined visible light when they are excited by light generated due to the discharge caused between the scanning and maintaining electrodes, and a discharge gas filled between the first and second substrates and which generates light due to the discharge caused between the scanning and maintaining electrodes;

a first driver connected to the scanning trace electrodes and which applies a voltage for selecting the scanning electrodes row by row and a voltage for causing, in interaction with a voltage applied to the scanning electrodes, a discharge between those of the scanning and maintaining electrodes where wall charges have been generated;

a second driver connected to the maintaining trace electrodes, and which applies a voltage according to display data to the maintaining electrodes corresponding to the scanning electrodes of a row currently selected by the first driver, and which applies a voltage for causing a discharge between those of the scanning and maintaining electrodes where wall charges have been generated depending on the voltage according to the display data; and a controller which controls operations of the first and second drivers.

In the plasma display described above, only two types of electrodes, i.e., the scanning electrodes and the maintaining electrodes, are provided in the plasma display panel. Hence, only two drivers, i.e., the first and second drivers, will suffice to drive the plasma display.

In the above-described plasma display, the first driver may apply a first predetermined voltage for causing a discharge between each of the scanning electrodes and a corresponding one of the maintaining electrodes in order to generate wall charges therebetween. The first driver may apply a predetermined second voltage to the scanning electrodes, while the second driver may apply a predetermined third voltage to the maintaining electrodes, in order that the wall charges, generated between the scanning and maintaining electrodes, will be erased by an interaction between the predetermined second and third voltages. The first driver may apply a predetermined fourth voltage for selecting the scanning electrodes row by row, while the second driver may apply a predetermined fifth voltage according to display data to the maintaining electrodes corresponding to the scanning electrodes of a row currently selected by the first driver, in order that a discharge will be caused between the selected scanning electrodes and their corresponding maintaining electrodes so as to generate wall charges therebetween, by an interaction between the predetermined fourth and fifth voltages. The first driver may apply a predetermined sixth voltage to the maintaining electrodes, while the second driver may apply a predetermined seventh voltage to the maintaining electrodes, in order that a discharge will be caused between those of the scanning and maintaining electrodes where the wall charges have been generated, by an interaction between the predetermined sixth and seventh voltages.

According to the third aspect of the present invention, there is provided a plasma display drive method comprising:

preparing a plasma display panel which includes a first substrate on which are sequentially formed a matrix of surface discharge electrodes arranged in rows and columns, a plurality of scanning trace electrodes, a plurality of maintaining trace electrodes and a first dielectric layer, each of the surface discharge electrodes comprising a scanning electrode and a maintaining electrode arranged with a predetermined gap in between and which cause a discharge upon a voltage application, each of the scanning trace electrodes connecting the scanning electrodes included in one of the rows of the matrix, the maintaining trace electrodes extending in a direction which is substantially perpendicular to the scanning trace electrodes and intersecting the scanning trace electrodes with insulators being provided between the scanning trace and maintaining trace electrodes, each of the maintaining trace electrodes connecting the maintaining electrodes included in one of the columns of the matrix, the first dielectric layer having an insulation property and covering the scanning electrodes and maintaining electrodes of the surface discharge electrodes, the scanning trace electrodes and the maintaining trace electrodes, a second substrate facing the first substrate and on which are sequentially formed a second dielectric layer having an insulation property and a plurality of phosphor layers which emit predetermined visible light when they are excited by light generated due to the discharge caused between the scanning and maintaining electrodes, and a discharge gas filled between the first and second substrates and which generates light due to the discharge caused between the scanning and maintaining electrodes;

applying a predetermined voltage to each of the scanning electrodes through the scanning trace electrodes, thereby causing a discharge between the scanning and maintaining electrodes in order to generate wall charges between the scanning and maintaining electrodes;

applying a predetermined voltage to each of the scanning electrodes through the scanning trace electrodes, while applying a predetermined voltage to each of the maintaining electrodes through the maintaining trace electrodes, thereby erasing the wall charges which have been generated between the scanning and maintaining electrodes;

sequentially applying a predetermined voltage to the scanning electrodes through the scanning trace electrodes in order to select the scanning electrodes row by row, while applying a voltage according to display data to the maintaining electrodes through the maintaining trace electrodes in synchronization with the voltage application to the scanning electrodes, thereby causing a discharge between the scanning and maintaining electrodes in order to generate wall charges between the scanning and maintaining electrodes; and applying a predetermined voltage to each of the scanning electrodes through the scanning trace electrodes, while applying a predetermined voltage to each of the maintaining electrodes through the maintaining trace electrodes, thereby causing a discharge between those of the scanning and maintaining electrodes where the wall charges have been generated.

DETAILED DESCRIPTION OF THE PREFERRED EMBODIMENT

Preferred embodiments of the present invention will now be described with reference to the accompanying drawings.

Figure 1:
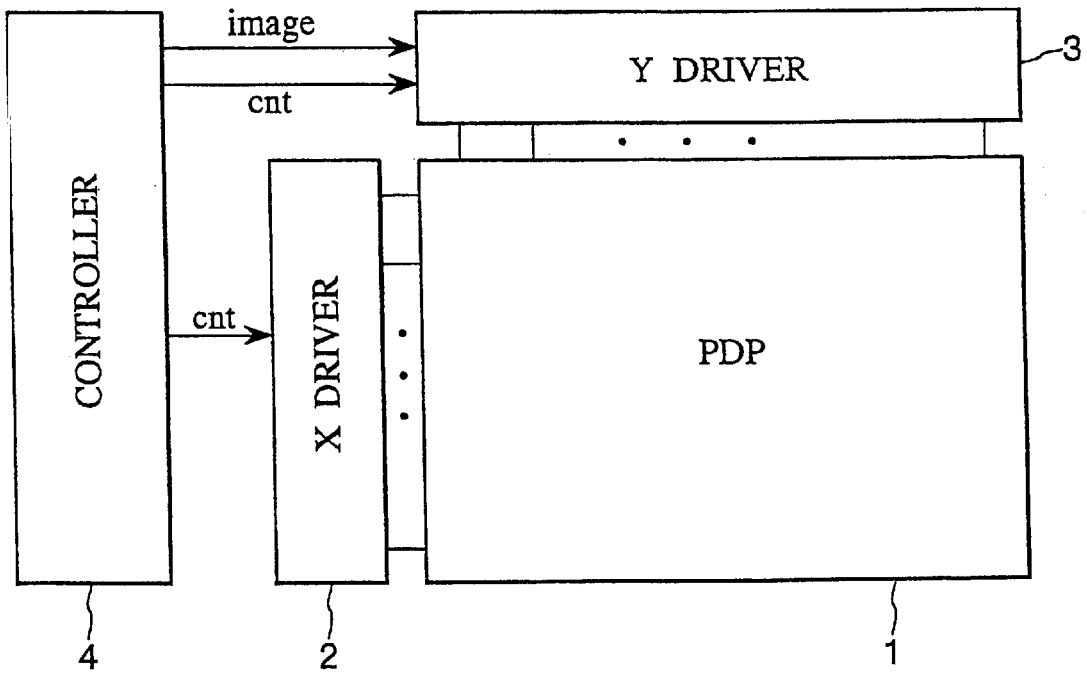
FIG. 1 is a block diagram showing the structure of a plasma display apparatus according to an embodiment of the present invention.

FIG. 1 is a block diagram showing the structure of the plasma display apparatus according to one embodiment of the present invention. As illustrated, this plasma display apparatus comprises a plasma display panel (PDP)1, an X driver 2, a Y driver 3 and a controller 4.

The PDP 1 comprises transparent front and rear substrates having an insulation property and arranged facing each other. The PDP 1 is an AC memory type color plasma display panel which displays a color image when its phosphor or fluorescent layers are excited by ultraviolet rays generated due to a gas discharge.

Figure 2:
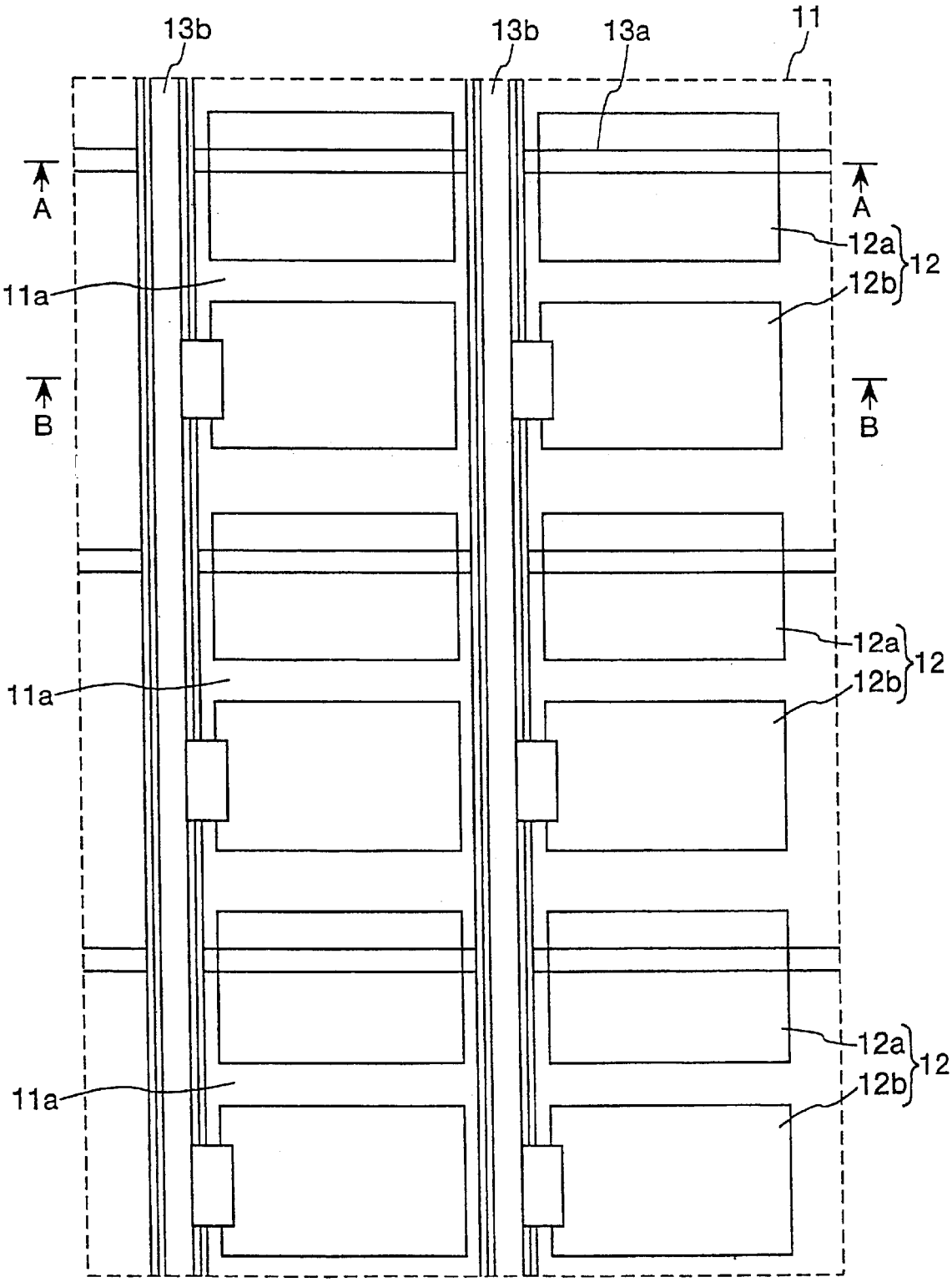
FIG. 2 is a diagram which illustrates in plan view the structure of the front substrate of the plasma display panel depicted in FIG. 1.
Figure 3:
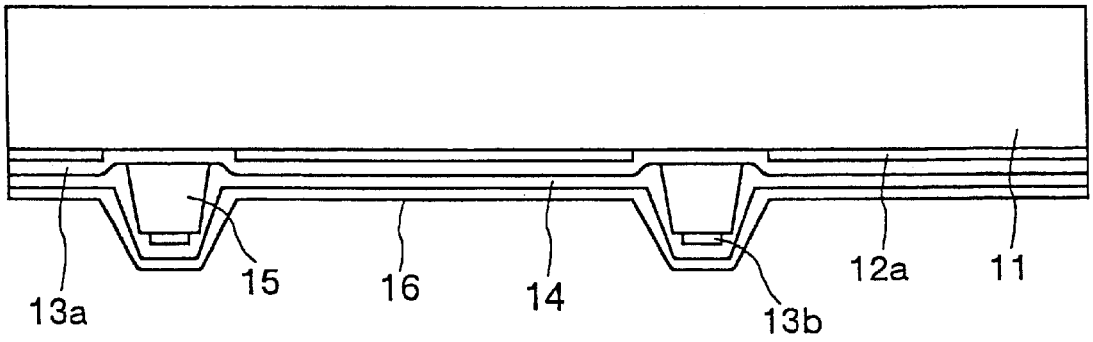
FIG. 3 is a diagram showing a cross section taken along line A—A of FIG. 2.
Figure 4:
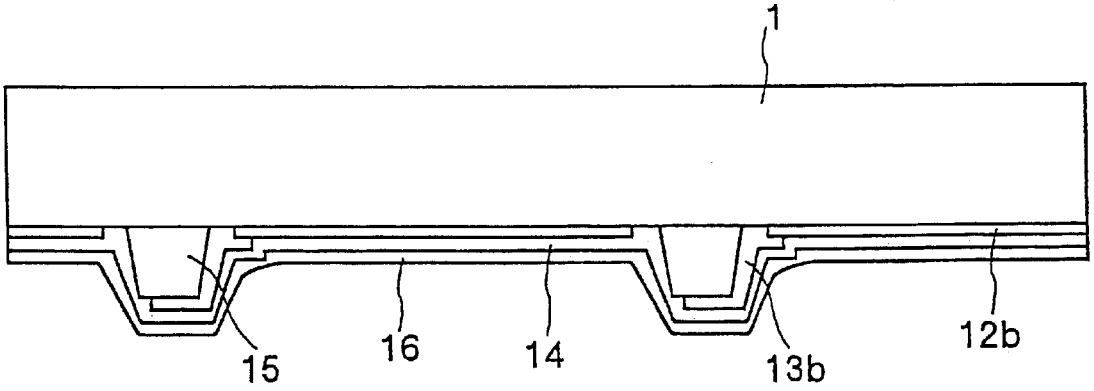
FIG. 4 is a diagram showing a cross section taken along line B—B of FIG. 2.
Figure 5:
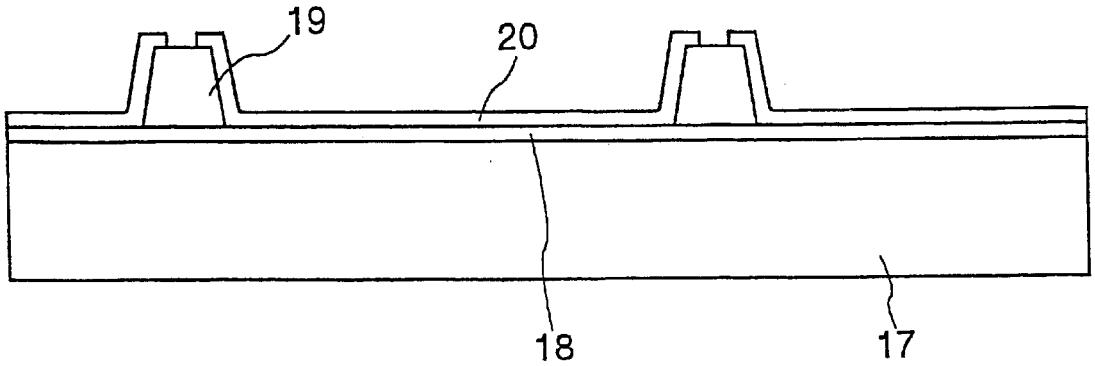
FIG. 5 is a diagram which illustrates in cross section the structure of the rear substrate of the plasma display panel depicted in FIG. 1.

The structure of the PDP 1 will now be described with reference to FIGS. 2 to 5. FIG. 2 is a diagram which illustrates in plan view the structure of the front substrate (especially the structures of its electrodes) of the PDP 1. FIG. 3 is a diagram showing a cross section taken along line A—A of FIG. 2, while FIG. 4 is a diagram showing a cross section taken along line B—B of FIG. 2. FIG. 5 is a diagram which illustrates in cross section the structure of the rear substrate of the PDP 1. FIG. 2 depicts the rear substrate of the PDP 1 when viewed from a direction perpendicular to the rear substrate.

A rectangular scanning electrode 12*a* and a rectangular maintaining electrode 12*b* are formed on the front substrate 11, with a surface discharge gap 11*a* between the electrodes 12*a* and 12*b*. Each of the scanning electrode 12*a* and the maintaining electrode 12*b* is made of transparent electrode material such as $SnO_2$ or ITO (Indium Tin Oxide). The scanning electrode 12*a* and the maintaining electrode 12*b* adjacent thereto form a surface discharge electrode 12.

A plurality of pairs (surface discharge electrodes 12) of scanning and maintaining electrodes 12*a* and 12*b* are formed one for each discharge cell of the PDP 1, and are arranged in matrix pattern on the front substrate 11. The scanning electrodes 12*a* are connected to their corresponding scanning trace (bus) electrodes 13*a* formed along a horizontal direction (X direction: a row direction) and which are made of opaque metal material. The maintaining electrodes 12*b* are connected to their corresponding maintaining trace (bus) electrodes 13*b* formed along a vertical direction (Y direction: a column direction). The metal material forming the scanning trace and maintaining trace electrodes 13*a* and 13*b* has a sheet resistance lower than that of the transparent electrode material forming the scanning and maintaining electrodes 12*a* and 12*b*.

A plurality of first partition walls 15 are formed between the scanning electrodes 12*a*, as well as between the maintaining electrodes 12*b*, so that the first partition walls 15 extend vertically on the scanning trace electrodes 13*a*. The maintaining trace electrodes 13*b* are crossed over the scanning trace electrodes 13*a* in the state wherein the maintaining trace electrodes 13*b* are insulated from the scanning trace electrodes 13*a* by the first partition walls 15. The scanning trace electrodes 13*a*, having a thickness of approximately 1 $\mu$m, are formed from a Cr/Cu/Cr multilayered thin film or an aluminum thin film.

According to the above-described structure, the surface discharge electrodes 12, each comprising a scanning electrode 12*a* and a maintaining electrode 12*b*, are formed one for each discharge cell (display pixel). The surface discharge electrodes 12 are arranged in a matrix form on the front substrate 11. The first partition walls 15 are formed in stripes so that they insulate the discharge cells from each other, in order to insure a discharge space between the front and rear substrates 11 and 17 arranged facing each other, and in order to ensure a dielectric strength between the scanning trace and maintaining trace electrodes 13*a* and 13*b*. The scanning electrodes 12*a* and the maintaining electrodes 12*b* are formed so that they are narrower than (so that their lateral dimensions in FIG. 2 are less than the width of) a space defined between their adjacent first partition walls 15, in order to enhance the efficiency of discharge between each pair of scanning and maintaining electrodes 12*a* and 12*b*.

The first partition walls 15 are made of material whose main component is lead glass having a low melting point and which contains aluminum oxide, magnesia oxide, black pigment, etc. Using thick film techniques such as thick film printing techniques, additive techniques and sand blasting techniques, the first partition walls 15 are formed having a thickness of 30 μm to 50 μm. The first partition walls 15 are formed as poreless, dense films by causing them to reflow satisfactorily, in order to ensure a satisfactorily great dielectric strength between the scanning trace and maintaining trace electrodes 13*a* and 13*b*.

A transparent dielectric layer 14 having a light transmission property is formed on the front substrate 11 so as to cover the scanning electrodes 12*a*, the maintaining electrodes 12*b*, the scanning trace electrodes 13*a*, the maintaining trace electrodes 13*b* and the first partition walls 15. The transparent dielectric film 14 is formed having a thickness of 20 μm to 40 μm by printing and sintering paste whose main component is lead glass. In order to prevent dielectric breakdown at the time of a discharge, the transparent dielectric film 14 is formed as a poreless, dense film by causing it to reflow satisfactorily at a temperature equal to or exceeding a lead glass softening point.

A magnesia oxide (MgO) layer 16, having a thickness of 0.5 μm to 1 μm, is formed on the transparent dielectric layer 14 by vapor deposition. The magnesia oxide layer 16 can be formed by printing or spraying it on the transparent dielectric layer 14. Since the magnesia oxide layer 16 is made of discharge proof material which is high in a count of discharged secondary electrons, the magnesia oxide layer 16 stabilizes a discharge voltage and permits a low voltage to be used as the discharge voltage.

A white dielectric layer 18 is formed on the rear substrate 17. The white dielectric layer 18 is formed by printing and sintering thick film paste which contains a mixture of lead glass having a low melting point and white pigment. In general, titanium oxide or aluminum oxide powder is used as the white pigment.

A plurality of second partition walls 19 are formed in stripes on the white dielectric layer 18 along the horizontal direction. Using thick film techniques such as thick film printing techniques, additive techniques and sand blasting techniques, the second partition walls 19 made of material whose main component is low melting point glass and which contains aluminum oxide, magnesia oxide or the like, are formed having a thickness of 80 μm to 100 μm. The second partition walls 19, formed on the rear substrate 17, prevent an erroneous discharge and optical crosstalk from occurring between the discharge cells (display pixels) adjacent to each other, in cooperation with the first partition walls 15 formed on the front substrate 11. The second partition walls 19, which are white partition walls that reflect visible light with ease, enable the visible light emitted from phosphor or fluorescent layers 20 to be utilized with high efficiency, as will be explained later.

Figure 6:
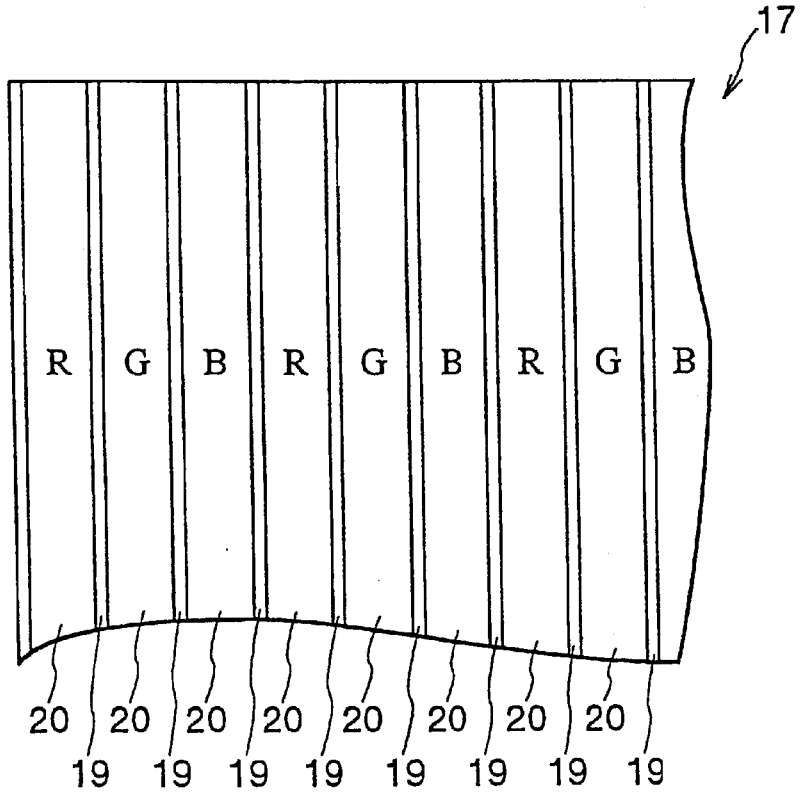
FIG. 6 is a diagram illustrating the arrangement of phosphor layers formed on the rear substrate of the plasma display panel.

As illustrated in FIG. 6, the phosphor layers 20 are formed on the white dielectric layer 18 by forming separate stripe coatings of three phosphor materials which correspond to red (R), green (G) and blue (B), respectively. The phosphor layers 20, when excited by ultraviolet rays generated due to a discharge, emit visible light of their corresponding colors. In order to attain a high luminance, the phosphor layers 20 are formed also on the sides of the second partition walls 19.

In general, screen printing techniques are employed to form the phosphor layers 20.

Figure 7:
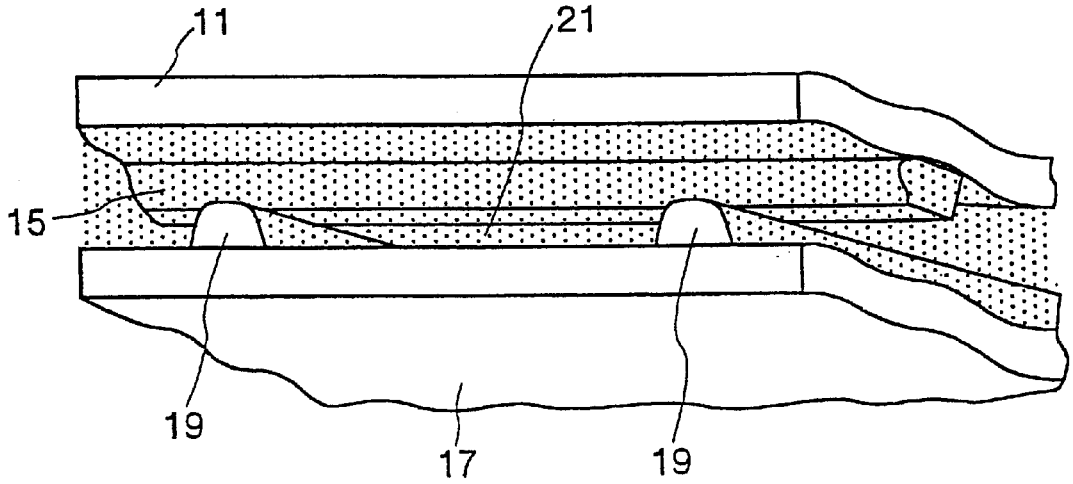
FIG. 7 is a diagram showing the state in which the front substrate illustrated in FIG. 3 and the rear substrate illustrated in FIG. 4 are arranged facing each other.

The front substrate 11 and the rear substrate 17 are opposed to each other so that the first and second partition walls 15 and 19 intersect each other at right angles, as illustrated in FIG. 7. The discharge space between the front substrate 11 and the rear substrate 17 is filled with a discharge gas 21 which contains He (helium), Ne (neon) and Xe (xenon) under a pressure of approximately 0.5 to 0.7 atm, as shown in FIG. 7. The peripheral portions of the front and rear substrates 11 and 17 are hermetically sealed by a seal member which is made of lead glass having a low melting point. The seal member is formed on either the front substrate 11 or the rear substrate 17 by using screen printing techniques and dispenser techniques. The PDP 1 illustrated in FIG. 1 is thus formed by the above-described procedures.

Returning to FIG. 1, the X driver 2 is connected to the scanning trace electrodes 13*a* of the PDP 1. In accordance with control signals from the controller 4, the X driver 2 applies predetermined drive voltages to the scanning trace electrodes 13*a* during a preliminary lighting period, a preliminary erasing period, a writing period and a maintaining period which will be explained later.

The Y driver 3 is connected to the maintaining trace electrodes 13*b* of the PDP 1. The Y driver 3 sequentially fetches image signals in accordance with control signals from the controller 4, applies the corresponding data voltages to the maintaining trace electrodes 13*b* in the writing period, and applies predetermined drive voltages to the maintaining trace electrodes 13*b* in the preliminary erasing period and the maintaining period which will be explained later.

Based on an externally supplied video signal, the controller 4 generates image signals for displaying images on the PDP 1, and sequentially supplies the generated image signals to the Y driver 3. In synchronization with the timing of supply of the image signals to the Y driver 3, the controller 4 supplies control signals to the X driver 2 and the Y driver 3, thereby controlling the operations of the X driver 2 and Y driver 3.

The operation of the plasma display apparatus according to this embodiment will now be described. In the explanations which will be made hereinafter, let it be assumed that the PDP 1 has the discharge cells (the surface discharge electrodes 12: the display pixels) the number of which is n (direction)×m (Y direction).

When the controller 4 receives externally supplied video signals, it generates control signals for controlling the X driver 2, the Y driver 3 and the internal circuitry of the controller 4, in accordance with synchronization signals contained in the video signals. Furthermore, based on Y signals and C signals contained in the video signals, the controller 4 generates image signals corresponding to the pixels (discharge cells) of the PDP 1 in accordance with internal control signals. Those control signals and the image signals are produced for the purpose of realizing a subfield drive method.

The controller 4 supplies the control signals to the X driver 2, and supplies the image signals and the control signals to the Y driver 3. In accordance with those signals, the X driver 2 and the Y driver 3 drive the PDP 1.

Figure 8A:
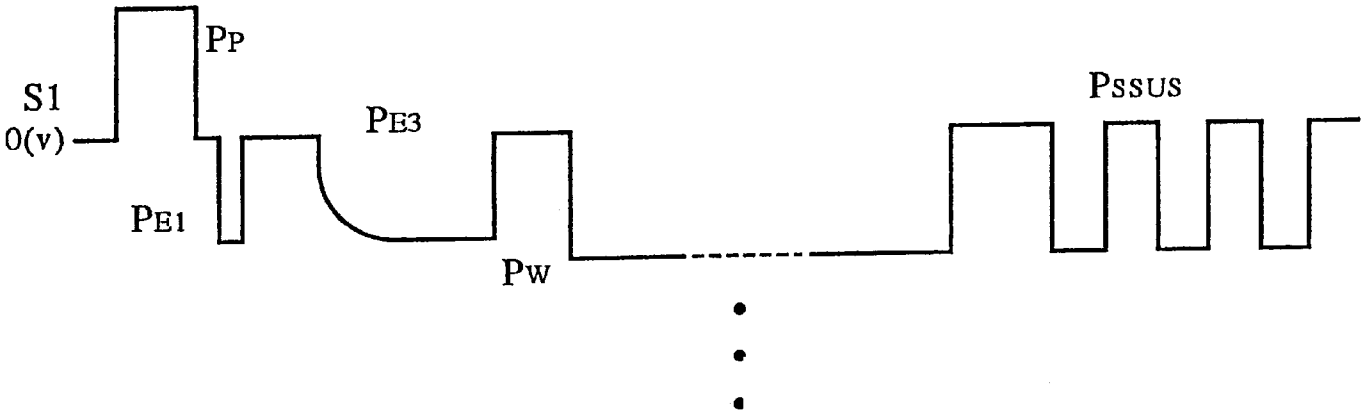
FIGS. 8A to 8C are diagrams illustrating the waveforms of drive voltage pulses for the plasma display panel depicted in FIG. 1.
Figure 8B:
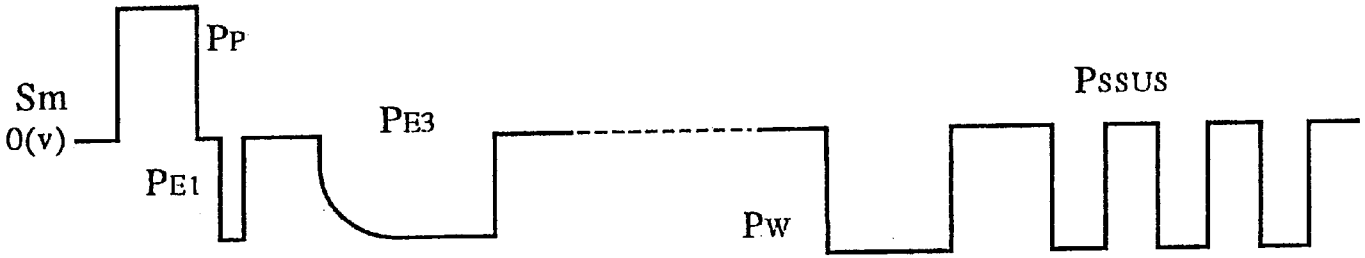
Figure 8C:
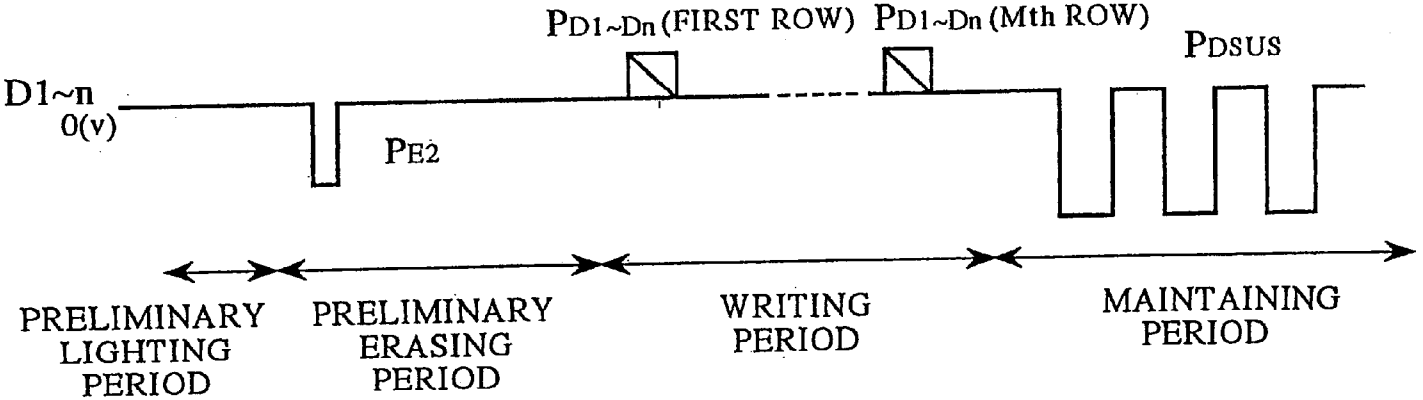
Figure 9:
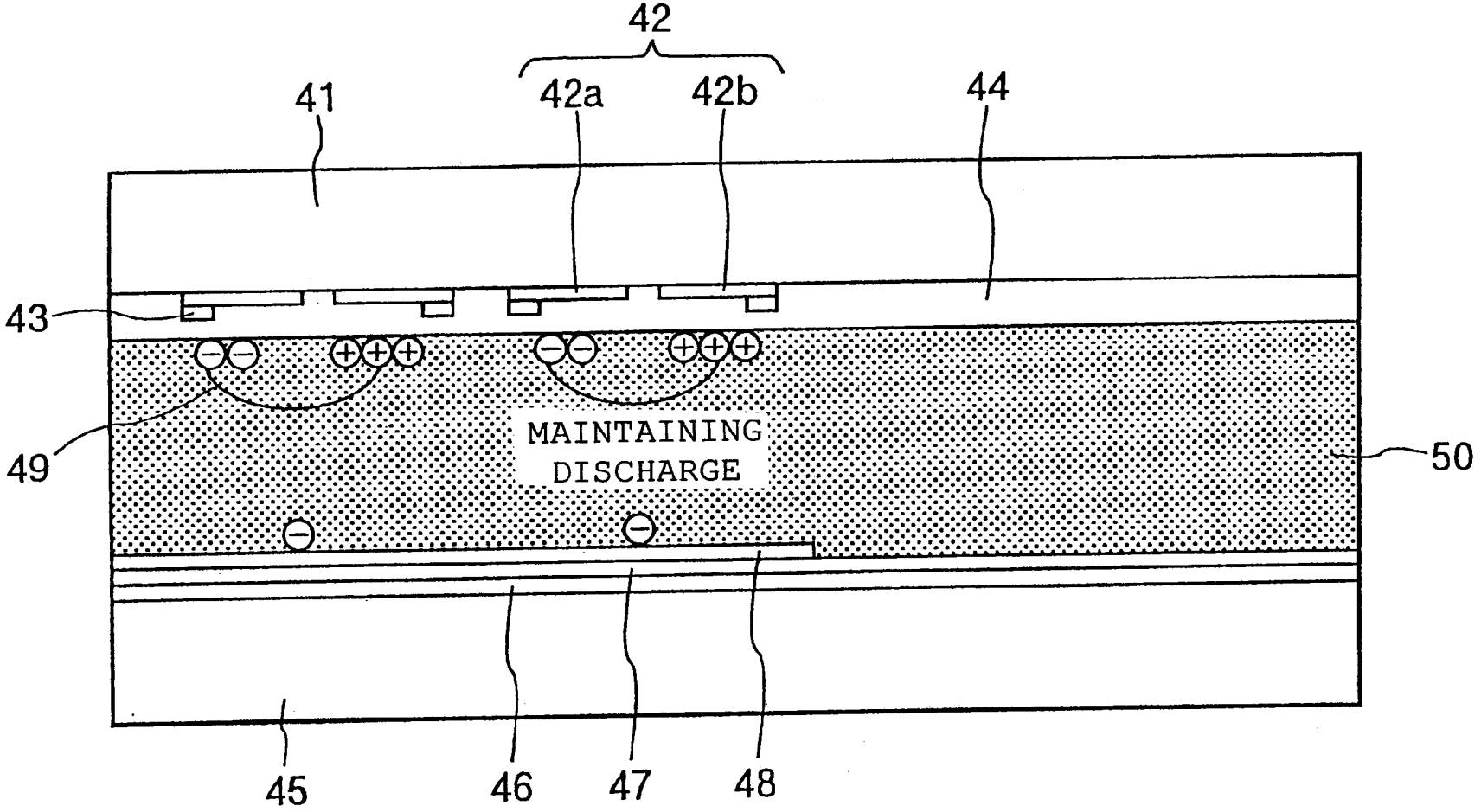
FIG. 9 PRIOR ART
FIG. 9 is a diagram which illustrate in cross section the structure of a conventional AC memory type plasma display panel.

FIGS. 8A to 8C are diagrams illustrating the waveforms of drive voltage pulses which the X driver 2 and the Y driver 3 use to drive the PDP 1. In FIGS. 8A and 8B, reference symbols S1 and Sm respectively represent a train of drive voltage pulses which is applied to the first scanning trace electrode 13*a* (the display pixels of the top row, among the display pixels arranged in a matrix form) and a train of drive voltage pulses which is applied to the $m^{th}$ scanning trace electrode 13*a* (the display pixels of the bottom row). In FIG. 8C, reference symbol "$P_{D1}$~$P_{Dn}$" represents voltages which are applied to the maintaining trace electrodes 13*b* in the first to $n^{th}$ columns.

According to the method by which the X driver 2 and the Y driver 3 drive the PDP 1, a subfield period is divided into four, i.e., (I) the preliminary lighting period; (II) the preliminary erasing period; (III) the writing period; and (IV) the maintaining period. The operations assigned to the four respective periods described above are repeated subfield by subfield. The drive operation to be carried out in each of the four aforementioned periods will now be described.

(I) Preliminary Lighting Period

In the preliminary lighting period, the X driver 2 firstly applies a rectangular preliminary lighting pulse $P_P$ with a positive polarity to all of the scanning trace electrodes 13*a* in the first to $m^{th}$ rows in accordance with the control signals supplied from the controller 4, as shown in FIGS. 8A and 8B. By so doing, the preliminary lighting pulse $P_P$ with a positive polarity is applied to the scanning electrodes 12*a* of all display pixels such that a discharge is caused between the scanning and maintaining electrodes 12*a* and 12*b* of all surface discharge electrodes 12. Due to this discharge, wall charges are accumulated between the scanning and maintaining electrodes 12*a* and 12*b* of all discharge cells.

(II) Preliminary Erasing Period

In the preliminary erasing period, the X driver 2 firstly applies a rectangular preliminary erasing pulse $P_{E1}$ with a negative polarity to all of the scanning trace electrodes 13*a* in the first to $m^{th}$ rows in accordance with the control signals supplied from the controller 4, as shown in FIGS. 8A and 8B. Next, the Y driver 3 applies a rectangular preliminary erasing pulse $P_{E2}$ with a negative polarity to all of the maintaining trace electrodes 13*b* in the first to $n^{th}$ columns in accordance with the control signals supplied from the controller 4, as shown in FIG. 8C.

Furthermore, the X driver 2 applies a preliminary pulse $P_{E3}$ with a negative polarity to all of the scanning trace electrodes 13*a* in the first to $m^{th}$ rows in accordance with the control signals supplied from the controller 4, as shown in FIGS. 8A and 8B. The preliminary erasing pulse $P_{E3}$ has such a substantially rectangular waveform that the pulse rises gradually, as illustrated in FIGS. 8A and 8B.

By thus applying the preliminary erasing pulses $P_{E1}$, $P_{E2}$ and $P_{E3}$ to the scanning electrodes 12*a* or the maintaining electrodes 12*b* in sequence, the wall charges accumulated between the scanning and maintaining electrodes 12*a* and 12*b* during the preliminary lighting period are erased.

(III) Writing Period

In the writing period, the X driver 2 applies a selecting pulse $P_W$ to the scanning trace electrodes 13*a* in the first to $m^{th}$ rows, while causing the pulse to rise negatively in accordance with the control signals from the controller 4 and while varying the pulse duration for each of the scanning trace electrodes 13*a*, as shown in FIGS. 8A and 8B. Meanwhile, in synchronization with the rising of the selecting pulse $P_W$, the Y driver 3 applies data pulses $P_{D1}$ to $P_{Dn}$ with a positive polarity to the maintaining electrodes 12*b* through those of the maintaining trace electrodes 13*b* in the first to $n^{th}$ columns which correspond to display data, while causing the pulses to rise positively, as shown in FIG. 8C.

In those of the surface discharge electrodes 12 which include the maintaining electrodes 12*b* thus supplied with the data pulses $P_{D1}$ to $P_{Dn}$ in synchronization with the application of the selecting pulse $P_W$ to the scanning electrodes 12*a*, a discharge occurs between the scanning and maintaining electrodes 12*a* and 12*b*, and wall charges are accumulated therebetween as a result.

(IV) Maintaining Period

In the maintaining period, as shown in FIGS. 8A and 8B, the X driver appliesa rectangular maintaining pulse $P_{SSUS}$ with a negative polarity to all of the scanning trace electrodes 13*a* in the first to $m^{th}$ rows in accordance with the control signals from the controller 4. As shown in FIG. 8C, the Y driver 3 applies a rectangular maintaining pulse $P_{DSUS}$ with a negative polarity to all of the maintaining trace electrodes 13*b* in the first to $n^{th}$ columns in accordance with the control signals from the controller 4. The maintaining pulses $P_{SSUS}$ and $P_{DSUS}$ differ from each other in the timing of rise and fall; for example, when the maintaining pulse $P_{SSUS}$ rises, the maintaining pulse $P_{DSUS}$ falls, whereas when the maintaining pulse $P_{SSUS}$ falls, the maintaining pulse $P_{DSUS}$ rises, as seen from FIGS. 8A to 8C.

In some discharge cells whose scanning and maintaining electrodes 12*a* and 12*b* have the wall charges accumulated therebetween as a result of the data pulses $P_D$ being applied in the writing period, the voltages of the maintaining pulses $P_{SSUS}$ and $P_{DSUS}$, applied to all scanning trace electrodes 13*a* and all maintaining trace electrodes 13*b*, are superimposed on a potential caused by the wall charges such that a discharge occurs between the scanning and maintaining electrodes 12*a* and 12*b* and is maintained until the maintaining period ends.

Meanwhile, in the other discharge cells whose scanning and maintaining electrodes 12*a* and 12*b* have no wall charges accumulated between because of the non-application of the data pulses $P_D$ in the writing period, no discharge occurs between the scanning and maintaining electrodes 12*a* and 12*b*, notwithstanding the application of the maintaining pulses $P_{SSUS}$ and $P_{DSUS}$.

In the discharge cells where the discharge has occurred between the scanning and maintaining electrodes 12*a* and 12*b*, the discharge gas 21 sealed between the front substrate 11 and the rear substrate 17 absorbs the discharge energy and radiates ultraviolet rays. Further, the corresponding phosphor layers are excited by the ultraviolet rays such that each phosphor layer emits one of red, green and blue light rays which corresponds to the phosphor used therein. The light thus emitted from the phosphor layers 20 (a part of the light is reflected by the white dielectric layer 18, etc.) goes out of the PDP 1 as display light for displaying images, after passing through the magnesia oxide layer 16, the transparent dielectric layer 14, the scanning electrodes 12*a* or the maintaining electrodes 12*b*, and the front substrate 11.

The length of the maintaining period, i.e. in which the X driver 2 sequentially applies the maintaining pulse $P_{SSUS}$ sequentially to the scanning trace electrodes 13*a* and the Y driver 2 applies the maintaining pulse $P_{DSUS}$ sequentially to the maintaining trace electrodes 13*b*, is controlled for each subfield under the control of the controller 4.

Subfield images which are sequentially displayed on the PDP 1 in their respective maintaining periods by the above-described operations are visually synthesized into one field image by the afterimage effect on human eyes. When a plurality of field images synthesized in this manner are displayed one after another on the PDP 1, the viewer who is watching the PDP 1 recognizes them as moving images.

As described above, according to the plasma display apparatus of this embodiment, the electrodes are not formed under the phosphor layers 20 provided above the rear substrate 17. Hence, a discharge through the phosphor layers 20 does not occur, and therefore the phosphor layers 20 are not deteriorated or damaged due to the impingement of the electrons and other charged particles, ensuring long life of the phosphor layers 20.

Moreover, according to the plasma display apparatus of this embodiment, the structure of the rear substrate 17 is simple and does not pose many restrictions on the formation of the phosphor layers 20. This permits the phosphor materials for forming the phosphor layers 20 to be chosen from a wide range of selection. Further, since the electrons and other charged particles do not impinge against the phosphor layers 20, a considerable difference in the deterioration speed does not occur depending on a difference in phosphor material between the phosphor layers 20. Moreover, since no wall charges are generated on the phosphor layers 20, a difference in the quantity of accumulated charges, owing to a difference in phosphor material between the phosphor layers 20, does not occur. Therefore, in the case of forming separate coatings of red, green and blue phosphor materials as the phosphor layers 20 to provide a color display, a discharge is not influenced by a difference in phosphor material, and besides, the phosphor materials for the individual colors can be chosen from a wide range of selection.

Furthermore, according to the plasma display apparatus of this embodiment, no opaque trace electrodes are formed on the transparent maintaining electrodes 12*b*. Accordingly, the aperture ratio of the display pixels is higher than that of conventional plasma display apparatuses, permitting the light emitted from the phosphor layers 20 to be utilized with higher efficiency.

Moreover, according to the plasma display apparatus of this embodiment, the front substrate 11 is covered with the magnesia oxide layer 16. The presence of the magnesia oxide layer 16 ensures a discharge between the scanning and maintaining electrodes 12*a* and 12*b*, and permits a low voltage to be adopted as the voltage for causing the discharge. Moreover, by ensuring a discharge between the scanning and maintaining electrodes 12*a* and 12*b*, the wall charges are assuredly accumulated between the scanning and maintaining electrodes 12*a* and 12*b* when writing data.

Further, according to the plasma display apparatus of this embodiment, the surface discharge electrodes 12 having a size smaller than that of the discharge area enclosed by the first and second partition walls 15 and 19, are formed on the first substrate 11. Because of this, the electrons and ions generated at the time of a discharge do not disappear as a result of being recombined on the first and second partition walls 15, and therefore a discharge loss is suppressed.

Furthermore, according to the plasma display apparatus of this embodiment, the front and rear substrates 11 and 17 are arranged facing each other in the state wherein the first and second partition walls 15 and 19 are perpendicular to each other. Under this condition, when water and an impure gas such as carbon dioxide are removed from the plasma display panel 1 by heating the panel while vacuuming it, an impure gas evacuation path is formed extending in vertical and horizontal two directions. By virtue of the formation of the evacuation path extending in the two directions, the evacuation conductance at the time of the evacuation of the impure gas is improved.

Moreover, according to the plasma display apparatus of this embodiment, the PDP 1 has no data electrodes solely for writing data, and only the scanning trace electrodes 13*a* and the maintaining trace electrodes 13*b* are connected to an external of the PDP 1. In this case, only two drivers, i.e., the X driver 2 and the Y driver 2, need only be used to drive the PDP 1.

The present invention is not limited to the above-described embodiment, and various modifications and applications are possible. Modifications of the above-described embodiment, which are applicable to the present invention, will now be described.

In the above-described embodiment, the phosphor layers 20 are formed by providing stripe coatings of the phosphor materials, which respectively correspond to red, green and blue emission light, between the partition walls 19 on the white dielectric layer 18. However, the phosphor layers 20 may be formed by providing coatings of the phosphor materials which respectively correspond to red, green and blue emission light in accordance with an arrangement such as a delta arrangement, a square arrangement or the like and in correspondence with the individual pixels (discharge cells) of the PDP 1. The phosphor layers 20 may be made of a phosphor of only one kind so that monochrome images are displayed on the PDP 1.

In the above-described embodiment, the second partition wall 19 are formed intersecting the first partition walls 15 at right angles. However, the direction in which the first partition walls 15 extend and the direction in which the second partition walls 19 may be parallel with each other when the front substrate 11 and the rear substrate 17 are arranged facing each other. In this case, the intervals at which the second partition walls 19 are formed can be set equal to those at which the first partition walls 15 are formed. Moreover, in order to optically isolate the discharge cells from each other, strip-like coatings of a black insulating material may be formed on the front substrate 11 so that they extend perpendicular to the first partition walls 15. By so doing, the display contrast when the display is arranged in a bright place is improved. Furthermore, the first partition walls 15 or the second partition walls 19 can be formed not only extending vertically in stripes, but also extending horizontally in a lattice form so that the surface discharge electrodes 12 of the individual display pixels are insulated from each other.

In the above-described embodiment, the front substrate 11 is provided with the first partition walls 15, while the rear substrate 17 is provided with the second partition walls 19. However, at least one of the front substrate 11 and the rear substrate 17 needs only be provided with the partition walls for defining the discharge space. In the case where the front substrate 11 is provided with no partition walls, insulators for insulating the scanning trace and maintaining trace electrodes 13*a* and 13*b* from each other may be arranged at the intersections of the scanning trace and maintaining trace electrodes 13*a* and 13*b*.

Figure 10:
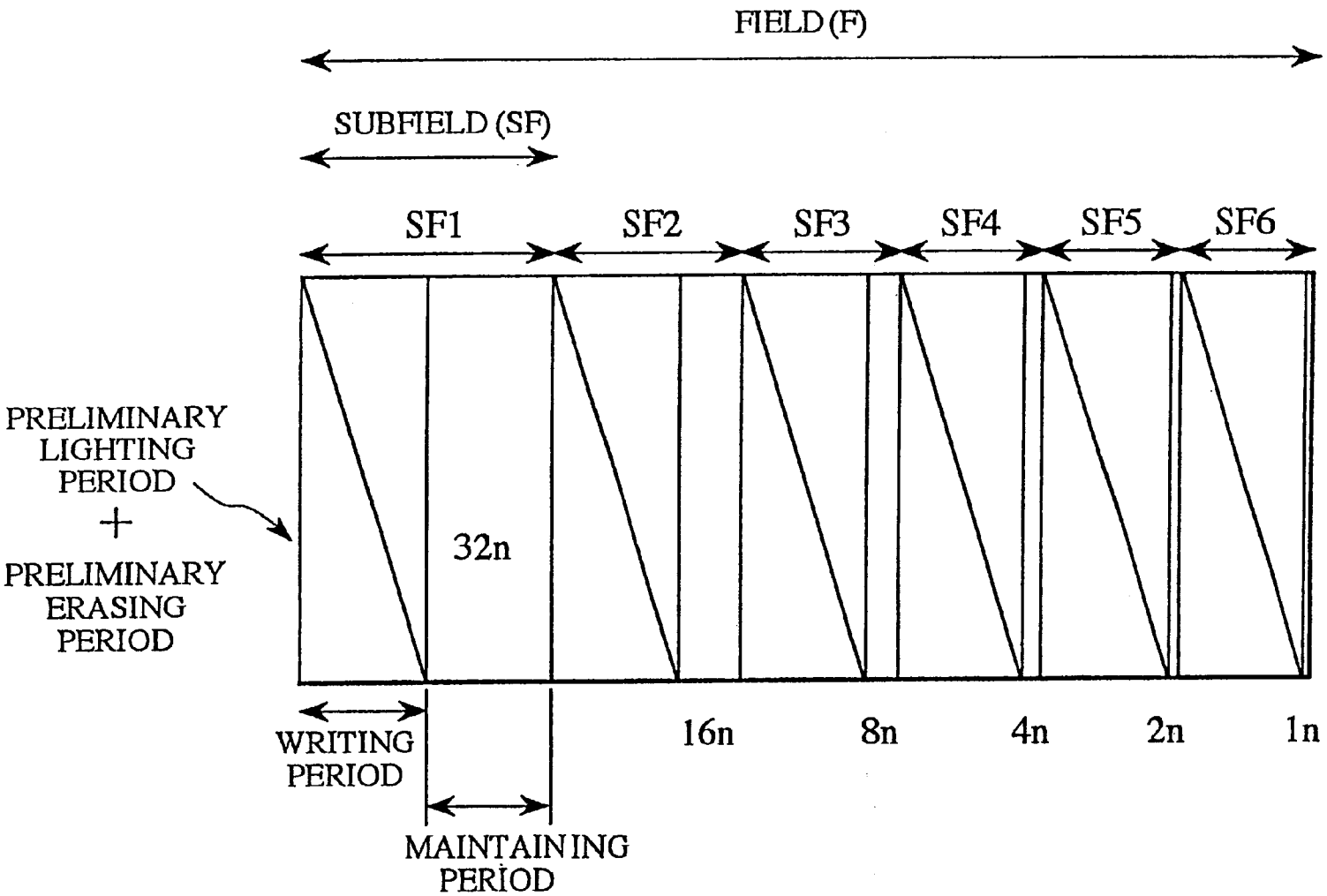
FIG. 10 PRIOR ART
FIG. 10 is a diagram for explaining a subfield drive method to perform gradation display on the plasma display panel.
Figures 11A, 11B, 11C, 11D:
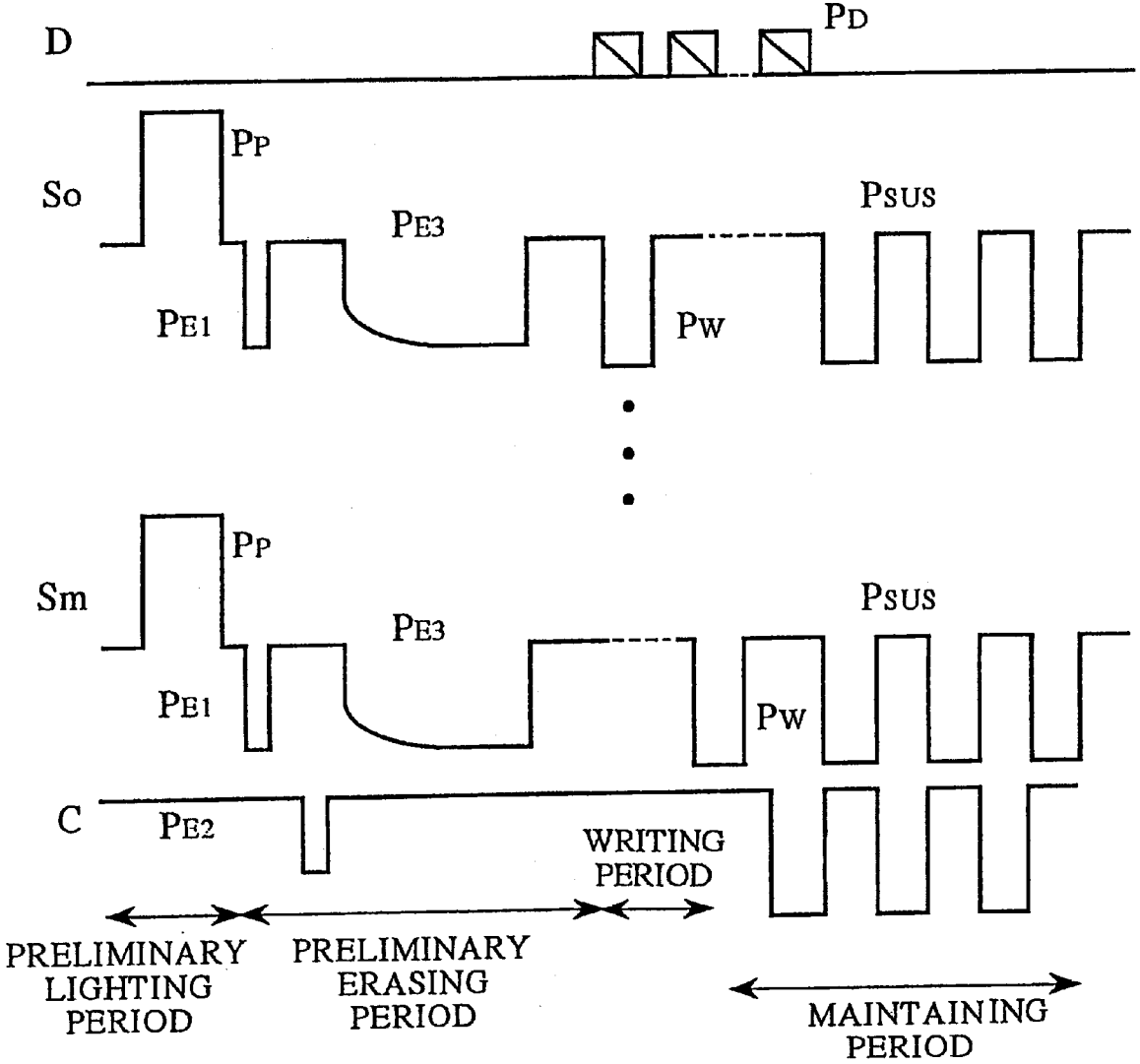
FIG. 11A PRIOR ART
FIG. 11B PRIOR ART
FIG. 11C PRIOR ART
FIG. 11D PRIOR ART
FIGS. 11A to 11D are diagrams illustrating the waveforms of drive voltage pulses for the plasma display panel depicted in FIG. 9.

According to the above-described embodiment, the controller 4 generates the control signals and the image signals, and supplies them to the X driver 2 or the Y driver 3 in order to realize the subfield drive method for causing the PDP 1 to display multi-gradation images, as shown in FIG. 10. However, the present invention is applicable also to the case where the subfield drive method is not practiced and the images are displayed in two gradations, dark and bright, on the PDP 1.

According to the above-described embodiment, the discharge gas 21 is a gas mixture containing helium, neon and xenon, and radiates ultraviolet rays due to the discharge caused between the scanning and maintaining electrodes 12*a* and 12*b*. However, the discharge gas 21 may be another type of gas mixture which radiates light whose wavelength is in the wavelength range different from that of the ultraviolet rays. In this case, the phosphor layers 20 need only be ones which emit light rays having predetermined wavelengths, such as red, green and blue light rays, when they are excited by light whose wavelength is in the range of the wavelengths of light rays that the discharge gas 21 radiates.

According to the above-described embodiment, the white dielectric layer 18 is formed on the rear substrate 17, and the phosphor layers 20 are formed on the white dielectric layer 18. The light rays which the phosphor layers 20 emit when excited by the ultraviolet rays generated due to the gas discharge, go out of the PDP 1 through the front substrate 11, and are used as the display light for the PDP 1. However, a dielectric layer which is made of transparent material can be formed in place of the white dielectric layer 18. In this case, the light rays emitted from the phosphor layers 20 may go out of the PDP 1 through the rear substrate 17.

What is claimed is:

1. A plasma display comprising:

a first substrate on which are sequentially formed a matrix of surface discharge electrodes arranged in rows and columns, a plurality of scanning trace electrodes, a plurality of maintaining trace electrodes and a first dielectric layer, each of said surface discharge electrodes comprising a scanning electrode and a maintaining electrode arranged with a predetermined gap in between and which cause a discharge upon a voltage application, each of said scanning trace electrodes connecting the scanning electrodes included in one of the rows of said matrix, said maintaining trace electrodes intersecting said scanning trace electrodes with insulators being provided between said scanning trace and maintaining trace electrodes, each of said maintaining trace electrodes connecting the maintaining electrodes included in one of the columns of said matrix, and said first dielectric layer having an insulation property and covering the scanning electrodes and maintaining electrodes of said surface discharge electrodes, said scanning trace electrodes and said maintaining trace electrodes;

a second substrate facing said first substrate and on which are sequentially formed a second dielectric layer having an insulation property and a plurality of phosphor layers, said phosphor layers emitting predetermined visible light when they are excited by light generated due to the discharge caused between said scanning and maintaining electrodes; and a discharge gas filled between said first and second substrates and which generates light due to the discharge caused between said scanning and maintaining electrodes.

2. The plasma display according to claim 1, wherein:

said first substrate is further provided with first partition walls extending in a direction which is substantially perpendicular to said scanning trace electrodes, and having an insulation property to insulate the columns of surface discharge electrodes from each other and to define a discharge space between said first and second substrates; and said maintaining trace electrodes are arranged on said first insulating partition walls.

3. The plasma display according to claim 2, wherein said scanning electrodes and said maintaining electrodes are narrower than a space defined between said first partition walls.

4. The plasma display according to claim 1, wherein:

said second substrate is further provided with second partition walls to define a discharge space between said first and second substrates; and said phosphor layers are arranged between said second partition walls.

5. The plasma display according to claim 1, wherein:

said first substrate is further provided with first partition walls extending in a direction which is substantially perpendicular to said scanning trace electrodes, and having an insulation property to insulate the columns of surface discharge electrodes from each other and to define a discharge space between said first and second substrates;

said maintaining trace electrodes are arranged on said first partition walls;

said second substrate is further provided with second partition walls to define a discharge space between said first and second substrates; and said phosphor layers are arranged between said second partition walls.

6. The plasma display according to claim 5, wherein:

said second partition walls are formed on said second substrate so as to intersect said first partition walls at right angles; and said first and second substrates are arranged facing each other in a state in which said first and second partition walls are in contact with each other, with the discharge space being defined between said first and second substrates.

7. The plasma display according to claim 1, wherein said first substrate has a discharge proof thin film formed on said first dielectric layer and which is high in a count of discharged secondary electrons.

8. The plasma display according to claim 7, wherein said thin film is made of magnesia oxide.

9. The plasma display according to claim 1, wherein:

said scanning electrodes and said maintaining electrodes are made of transparent electrode material;

said scanning trace electrodes and said maintaining trace electrodes are made of opaque metal material; and said first dielectric layer is made of transparent insulating material.

10. The plasma display according to claim 1, wherein said second dielectric layer has a property of reflecting predetermined visible light emitted from said phosphor layers.

11. The plasma display according to claim 1, wherein each of said phosphor layers comprises one of three phosphor materials which are arranged in a predetermined order and which respectively emit red, green and blue light when they are excited by the light generated due to the discharge.

12. The plasma display according to claim 10, wherein said second dielectric layer has a property of reflecting any visible light emitted from said phosphor layers.

13. The plasma display according to claim 1, wherein said discharge gas essentially consists of a rare gas mixture containing helium, neon and xenon, and emits ultraviolet rays for exciting said phosphor layers, due to the discharge caused between said scanning and maintaining electrodes.

14. A plasma display comprising:

a plasma display panel which includes a first substrate on which are sequentially formed a matrix of surface discharge electrodes arranged in rows and columns, a plurality of scanning trace electrodes, a plurality of maintaining trace electrodes and a first dielectric layer, each of said surface discharge electrodes comprising a scanning electrode and a maintaining electrode arranged with a predetermined gap in between and which cause a discharge upon a voltage application, each of said scanning trace electrodes connecting the scanning electrodes included in one of the rows of said matrix, said maintaining trace electrodes extending in a direction which is substantially perpendicular to said scanning trace electrodes and intersecting said scanning trace electrodes with insulators being provided between said scanning trace and maintaining trace electrodes, each of said maintaining trace electrodes connecting the maintaining electrodes included in one of the columns of said matrix, said first dielectric layer having an insulation property and covering the scanning electrodes and maintaining electrodes of said surface discharge electrodes, said scanning trace electrodes and said maintaining trace electrodes, a second substrate facing said first substrate and on which are sequentially formed a second dielectric layer having an insulation property and a plurality of phosphor layers which emit predetermined visible light when they are excited by light generated due to the discharge caused between said scanning and maintaining electrodes, and a discharge gas filled between said first and second substrates and which generates light due to the discharge caused between said scanning and maintaining electrodes;

a first driver connected to said scanning trace electrodes and which applies a voltage for selecting said scanning electrodes row by row and a voltage for causing, in interaction with a voltage applied to said scanning electrodes, a discharge between those of said scanning and maintaining electrodes where wall charges have been generated;

a second driver connected to said maintaining trace electrodes, and which applies a voltage according to display data to the maintaining electrodes corresponding to the scanning electrodes of a row currently selected by said first driver, and which applies a voltage for causing a discharge between those of said scanning and maintaining electrodes where wall charges have been generated depending on the voltage according to the display data; and a controller which controls operations of said first and second drivers.

15. The plasma display according to claim 14, wherein:

said first driver applies a first predetermined voltage for causing a discharge between each of said scanning electrodes and a corresponding one of said maintaining electrodes in order to generate wall charges therebetween;

said first driver applies a predetermined second voltage to said scanning electrodes, while said second driver applies a predetermined third voltage to said maintaining electrodes, in order that the wall charges, generated between said scanning and maintaining electrodes, will be erased by an interaction between said predetermined second and third voltages;

said first driver applies a predetermined fourth voltage for selecting said scanning electrodes row by row, while said second driver applies a predetermined fifth voltage according to display data to the maintaining electrodes corresponding to the scanning electrodes of a row currently selected by said first driver, in order that a discharge will be caused between the selected scanning electrodes and their corresponding maintaining electrodes so as to generate wall charges therebetween, by an interaction between said predetermined fourth and fifth voltages; and said first driver applies a predetermined sixth voltage to said maintaining electrodes, while said second driver applies a predetermined seventh voltage to said maintaining electrodes, in order that a discharge will be caused between those of said scanning and maintaining electrodes where the wall charges have been generated, by an interaction between said predetermined sixth and seventh voltages.

16. A plasma display drive method comprising:

preparing a plasma display panel which includes a first substrate on which are sequentially formed a matrix of surface discharge electrodes arranged in rows and columns, a plurality of scanning trace electrodes, a plurality of maintaining trace electrodes and a first dielectric layer, each of said surface discharge electrodes comprising a scanning electrode and a maintaining electrode arranged with a predetermined gap in between and which cause a discharge upon a voltage application, each of said scanning trace electrodes connecting the scanning electrodes included in one of the rows of said matrix, said maintaining trace electrodes extending in a direction which is substantially perpendicular to said scanning trace electrodes and intersecting said scanning trace electrodes with insulators being provided between said scanning trace and maintaining trace electrodes, each of said maintaining trace electrodes connecting the maintaining electrodes included in one of the columns of said matrix, said first dielectric layer having an insulation property and covering the scanning electrodes and maintaining electrodes of said surface discharge electrodes, said scanning trace electrodes and said maintaining trace electrodes, a second substrate facing said first substrate and on which are sequentially formed a second dielectric layer having an insulation property and a plurality of phosphor layers which emit predetermined visible light when they are excited by light generated due to the discharge caused between said scanning and maintaining electrodes, and a discharge gas filled between said first and second and which generates light due to the discharge caused between said scanning and maintaining electrodes;

applying a predetermined voltage to each of said scanning electrodes through said scanning trace electrodes, thereby causing a discharge between said scanning and maintaining electrodes in order to generate wall charges between said scanning and maintaining electrodes;

applying a predetermined voltage to each of said scanning electrodes through said scanning trace electrodes, while applying a predetermined voltage to each of said maintaining electrodes through said maintaining trace electrodes, thereby erasing the wall charges which have been generated between said scanning and maintaining electrodes;

sequentially applying a predetermined voltage to said scanning electrodes through said scanning trace electrodes in order to select said scanning electrodes row by row, while applying a voltage according to display data to said maintaining electrodes through said maintaining trace electrodes in synchronization with the voltage application to said scanning electrodes, thereby causing a discharge between said scanning and maintaining electrodes in order to generate wall charges between said scanning and maintaining electrodes; and applying a predetermined voltage to each of said scanning electrodes through said scanning trace electrodes, while applying a predetermined voltage to each of said maintaining electrodes through said maintaining trace electrodes, thereby causing a discharge between those of said scanning and maintaining electrodes where the wall charges have been generated.

* * * * *